US005932996A

United States Patent [19]

Liepe et al.

[11] Patent Number: 5,932,996

[45] Date of Patent: Aug. 3, 1999

[54] LOW COST CURRENT MODE CONTROL SWITCHING POWER SUPPLY WITHOUT DISCRETE CURRENT SENSE RESISTOR

[75] Inventors: Steven F. Liepe, Ft. Collins; Tessa H. Velasquez, Loveland; Kenneth G. Richardson, Ft. Collins, all of Colo.

[73] Assignee: Hewlett-Packard Co., Palo Alto, Calif.

[21] Appl. No.: 09/067,625

[22] Filed: Apr. 28, 1998

[51] Int. Cl.[6] ..... G05F 1/56; G05F 5/00

[52] U.S. Cl. ..... 323/284; 323/303

[58] Field of Search ..... 323/222, 226, 323/271, 273, 274, 282, 284, 299, 303

[56] References Cited

U.S. PATENT DOCUMENTS

| | | | |
|---|---|---|---|
| 4,983,905 | 1/1991 | Sano et al. | 323/274 |
| 5,394,076 | 2/1995 | Huykman | 323/222 |
| 5,471,130 | 11/1995 | Agiman | 323/303 |
| 5,684,392 | 11/1997 | Chang et al. | 323/303 |

OTHER PUBLICATIONS

"Switchmode Power Supply Handbook" by Keith Billings, copyright 1989, publishers McGraw–Hill, pp. 2.172–2.173.

"LM78XX Series Voltage Regulators", published in National Semiconductor Feb. 1995, pp. 1–6.

*Primary Examiner*—Matthew Nguyen

*Attorney, Agent, or Firm*—Alexander J. Neudeck

[57] ABSTRACT

A switching power supply that uses the intrinsic series resistance of an output bypass capacitor to sense changes in current flow through a switch that is connects between the input and output of the switching power supply. When the switch runs on, current flows from the input to the output and through a bypass capacitor. The intrinsic series resistance of the bypass capacitor develops a voltage across it as current flows through the capacitor. This voltage is used by a sense circuit to help determine when to shut off the switch. A low-cost regulator develops an output voltage that is divided and compared to a reference to determine if the input voltage is sufficient. If it is not, the power supply is not allowed to operate and the switch is not allowed to turn on.

5 Claims, 1 Drawing Sheet

LOW COST CURRENT MODE CONTROL SWITCHING POWER SUPPLY WITHOUT DISCRETE CURRENT SENSE RESISTOR

FIELD OF THE INVENTION

The present invention relates generally to electronic power supplies. More particularly the present invention relates to low cost current mode switching power supplies.

BACKGROUND OF THE INVENTION

One critical part of almost every electronic device is the power supply. The power supply may take an alternating current received from a power cord plugged into a wall socket and transforms it to a direct current. For example, a device operated in the United States may have a power supply that converts the 120-volt, 60-Hertz, AC line voltage into 5 volts DC for use by many common semiconductor circuits and devices. Another type of power supply used in many electronic devices converts one DC voltage to another DC voltage. Often this type of power supply is used to regulate a higher DC voltage down to a lower DC voltage that is compatible with the type of circuitry it will be running.

Manufacturers of electronic devices are continually seeking new ways to reduce the cost of producing these devices. Cost savings may be achieved in a variety of ways including improved manufacturing efficiency, economies of scale, and the use of lower cost or fewer components. When a manufacturer reduces the cost of producing an electronic device it can lead to increased sales, increased profit, or both.

Accordingly, reducing the cost of the power supply is a need continually felt in the electronics industry.

SUMMARY OF THE INVENTION

A preferred embodiment of the invention minimizes cost by eliminating the need for a current sense resistor. A preferred embodiment also implements an undervoltage lockout feature that keeps the power supply from attempting to regulate when the input voltage or current is insufficient. If the power supply attempted to regulate when there was not enough input voltage and current, the power supply may destroy itself. Current is sensed using the series resistance of a capacitor. A preferred embodiment also utilizes low-cost discrete components to implement these features so those power supply features that are not needed may be left out.

DETAILED DESCRIPTION OF THE PREFERRED EMBODIMENTS

Figure 1:
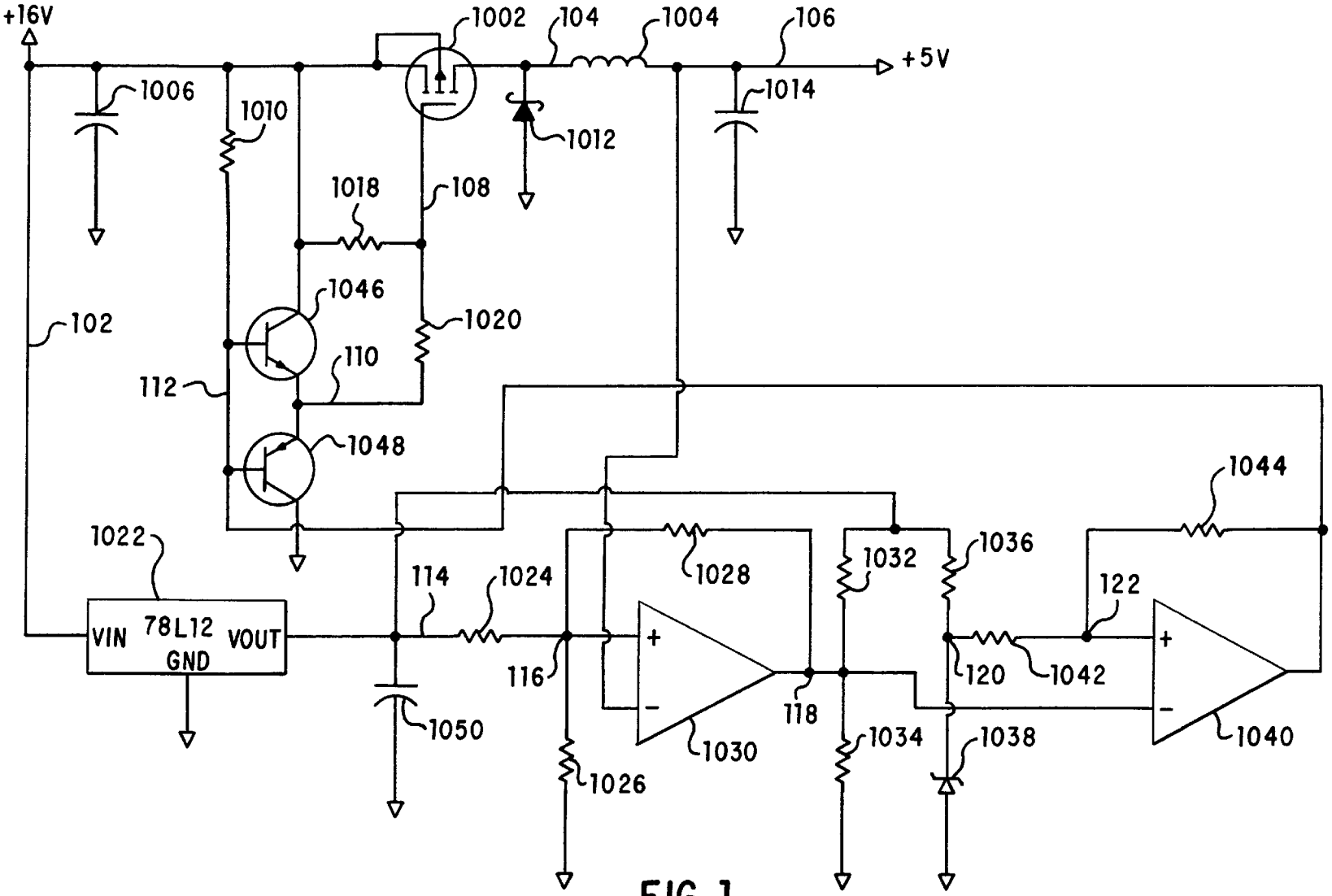
FIG. 1 is schematic illustrating the preferred embodiment.

Referring to FIG. 1, MOSFET 1002 behaves like a switch. Once the +16 volts is applied to node 102, MOSFET 1002 turns on. This allows current to flow through MOSFET 1002 and the voltage on capacitor 1014 begins to rise. This is the voltage at node 106. The voltage at node 106 is constantly being compared to the voltage at node 116. When the voltage at node 106 exceeds the voltage at node 116, MOSFET 1002 is turned off. When the voltage at node 106 falls below the voltage at reference node 116, then MOSFET 1002 is again turned on.

If the input voltage on node 102 does not exceed 13.4 volts, the power supply will not regulate. This is the undervoltage lockout protection. The input voltage may be too low for a variety of reasons including a malfunction, an overload, or as the device is powered up. Undervoltage lockout protection is important because without it, the power supply could start to oscillate and eventually destroy itself if it was not supplied enough input voltage and enough input current.

The 12 V regulator 1022 has a 1.4 V dropout voltage. Thus, if the input does not exceed 12 V by 1.4 V, the part will not regulate to 12 V. The output of regulator 1022 is divided by a resistive divider conisisting of resistors 1032 and 1034. The output of this divider is node 118. If the regulator 1022 does not produce a large enough output, the voltage at node 118 will be lower than the voltage at node 122. The voltage at node 122 is set by reference zener 1038. This will prevent the MOSFET 1002 from turning on. The values used in the resistive divider 1032, 1034 and the value of zener diode 1038 may be picked to set the undervoltage lockout at an appropriate input voltage.

$$V_{\lim} = V_{hys} + 2 \cdot V_{offset} + R\left[\left(\frac{di}{dt}\right) \cdot t_{pd}\right] \qquad \text{Equation 1}$$

The amount of voltage ripple on the output node 106 is governed by Equation 1. $V_{lim}$ is the ripple on the output voltage. $V_{hys}$ is the hysteresis provided at node 116. $V_{offset}$ is the amount of voltage offset in comparators 1030 and 1040. R is the series $$R \cdot \left(\frac{di}{dt}\right) = \frac{dv}{dt} \qquad \text{Equation 2}$$

resistance of capacitor 1014.

$$\frac{di}{dt}$$

is the change in current as the switch is closed and opened. $t_{pd}$ is the propagation delay of the comparators.

Equation 2 shows that the change in voltage across capacitor 1014 is due to the changing current across the series resistance of capacitor 1014. The dv portion of $$V_{\lim} = V_{hys} + 2 \cdot V_{offset} + V_{\lim} \cdot \frac{t_{pd}}{t_{on}} \qquad \text{Equation 3}$$

Equation 2 is $V_{lim}$, the ripple on the output voltage, and dt is $t_{on}$, the time the switch is closed. Substituting $V_{lim}$ for dv and $t_{on}$ for dt produces Equation 3.

Solving Equation 3 for $t_{on}$ yields Equation 4.

$$t_{on} = \frac{V_{\lim} \cdot t_{pd}}{V_{\lim} - V_{hys} - 2 \cdot V_{offset}} \qquad \text{Equation 4}$$

$$i(t) = \frac{V}{R_{load}} - \frac{V}{R_{load}} \cdot \exp\left(-\frac{R_{load}}{L} \cdot t_{on}\right) \qquad \text{Equation 5}$$

The current flowing through MOSFET 1002 when it is on can be modeled by Equation 5. The rate at which the current increases is determined by the RL time constant.

The current flowing through capacitor 1014 is i(t) which can be rewritten as $V_{lim}/R$. $V_{lim}$ is the change in the ripple voltage. The V portion of Equation 5 is the voltage across inductor 1004 and can be approximated as $V_{in}-V_{out}$ where $V_{in}$ is the input voltage at node 102 and $V_{out}$ is the output voltage at node 106. The amount of time that MOSFET 1002 is on is $t_{on}$. The value for $R_{load}$ can be determined by dividing the output voltage ($V_{out}$) by the load current ($I_{load}$). Making the above substitutions into Equation 5 yields Equation 7.

Equation 6 was obtained by applying a polynomial curve fit to the data in Table 1. The data in Table 1 was measured from another circuit. Equation 6 was used to calculate the inductance value, L.

TABLE 1

| LOAD CURRENT, $I_{load}$ (AMPS) | INDUCTANCE ($\mu$H) |
|---|---|
| 0.25 | 81.59 |
| 0.5 | 77.02 |
| 1.0 | 65.22 |
| 1.5 | 54.73 |
| 2.0 | 46.62 |

$$L=2.167\cdot(I_{load})^2-25.312\cdot I_{load}+88.336 \quad \text{Equation 6}$$

$$\frac{V_{\lim}}{R}=\frac{V_{\text{in}}\cdot V_{out}}{\left(\frac{V_{out}}{I_{load}}\right)}-\frac{V_{\text{in}}\cdot V_{out}}{\left(\frac{V_{out}}{I_{load}}\right)}\cdot\exp\left(-\frac{\left(\frac{V_{out}}{I_{load}}\right)}{L}\cdot t_{on}\right) \quad \text{Equation 7}$$

Equation 7 is solved for $t_{on}$ to yield Equation 8.

The unknown values in Equation 4 and Equation 8 are $t_{on}$ and $V_{lim}$. To solve for $V_{lim}$, Equation 4 is substituted for $t_{on}$ in Equation 8 and the result is solved for $V_{lim}$. Finding $V_{lim}$ may be accomplished via a number of methods including the use of a $$t_{on}=-\frac{L}{\frac{V_{out}}{I_{load}}}\cdot\ln\left[1-\frac{\frac{V_{\lim}}{R}\cdot\frac{V_{out}}{I_{load}}}{L\cdot(V_{\text{in}}-V_{out})}\right] \quad \text{Equation 8}$$

computer program with a numerical solving function. One such example is the numerical solver included in Microsoft Excel™ available from Microsoft Corporation, Redmond, Wash., U.S.A.

Once a value for $V_{lim}$, is found that value may be plugged into Equation 4 to determine a value for $t_{on}$. Using the property that $V_{in}-V_{out}$ may be approximated by L*di/dt, $t_{off}$ can be calculated. With $t_{on}$ and $t_{off}$ both known, the total period $T=t_{on}+t_{off}$ can be determined. Once the total period (T) is known, the frequency that the power supply oscillates at (F) may be calculated from the equation F=1/T.

A schematic of a preferred embodiment that converts a +16 V supply to a regulated +5 V supply is shown in FIG. 1. The +16 V supply is connected to node 102. Node 102 is connected to the input of an inexpensive three terminal regulator 1022. In a preferred embodiment, regulator 1022 is a LM7812 or its equivalent available from National Semiconductor Corporation. The ground terminal of regulator 1022 is connected to ground. The output terminal of regulator 1022 is connected to node 114. A 0.1 uF bypass capacitor 1050 is connected between node 114 and ground. A 4.75 kΩ resistor 1024 is connected between node 114 and node 116. A 3.4 kΩ resistor 1026 is connected between node 116 and ground. A 270 kΩ resistor 1028 is connected between node 116 and node 118.

The output of comparator 1030 is also connected to the inverting input of comparator 1040 via node 118. The positive supply terminals of comparators 1030 and 1040 are connected to the +16 V supply node 102. The non-inverting input of comparator 1030 is connected to node 116. The inverting input of comparator 1030 is connected to the output of the power supply, node 106. An 11 kΩ resistor 1034 is connected between node 118 and ground. A 10 kΩ resistor 1032 is connected between node 118 and node 114.

A 5.1 Volt zener diode 1038 is connected between node 120 and ground. The anode of zener diode 1038 is connected to ground; the cathode of zener diode 1038 is connected to node 120. A 1.3 kΩ resistor 1036 is connected between node 120 and node 114. A 4.75 kΩ resistor 1042 is connected between node 120 and node 122. Node 122 is also connected to the non-inverting input of comparator 1040. A 270 kΩ resistor 1044 is connected between node 122 and node 112. The output of comparator 1040 is connected to node 112.

A 470 uF capacitor 1006 is connected between node 102 and ground. A 2 kΩ resistor 1010 is connected between node 102 and node 112. The base of an NPN transistor 1046 is connected to node 112. The base of a PNP transistor 1048 is connected to node 112. The emitters of both NPN transistor 1046 and PNP transistor 1048 are both connected to node 110. The collector of PNP transistor 1048 is connected to ground. The collector of NPN transistor is connected to node 102.

A 4.75 kΩ resistor 1018 is connected between node 102 and node 108. A 49.9 Ω resistor 1020 is connected between node 110 and node 108.

The source and substrate of MOSFET 1002 are connected to node 102. MOSFET 1002 may be a p-channel enhancement FET such as an IRF7306 or its equivalents available from International Rectifier Corporation. The gate of MOSFET 1002 is connected to node 108. The drain of MOSFET 1002 is connected to node 104. A schottky diode 1012 with a 40-volt breakdown voltage is connected between node 104 and ground. The anode of schottky diode 1012 is connected to ground. Inductor 1004 is connected between node 104 and 106. The value of inductor 1004 is 72 uH in the preferred embodiment, but other values may be used.

Finally, a 330 uF bypass capacitor 1014 is connected between 106 and ground. It is the series resistance of capacitor 1014 that replaces a current sense resistor. This reduces part count and cost.

From the foregoing, it will be apparent that the invention provides a novel and advantages design for a switching power supply. The design reduces part count and hence cost by eliminating the need for a current sense resistor. The circuit will work with zero load. Finally, the circuit can be scaled for higher loads very easily.

Although a specific embodiment of the invention has been described and illustrated, the invention is not to be limited to the specific forms or arrangements of parts so described and illustrated. The invention is limited only by the claims.

What is claimed is:

1. A power supply, comprising:

an input node;

an output node;

a ground node;

a switching means, said switching means causing a current to flow from said input node to said output node when said switching means is on;

a capacitor, having a series resistance, connected between said output node and said ground node, said series resistance causing a change in a first voltage across said capacitor when said current flows;

a first sensing means, said first sensing means detecting when a voltage on said input node is above a threshold voltage; and, a second sensing means, wherein said switching means is turned on, and is kept on, while said second sensing means detects said change in said first voltage is causing said first voltage to exceed a second voltage on a reference node and said first sensing means detects that said voltage on said input node is above said threshold voltage and wherein said switching means is turned off, and kept off, while said second sensing means detects said first voltage is less than said second voltage on said reference node.

2. The power supply of claim 1, further comprising an inductor connected between said switching means and said output node for limiting the rate of change of said first voltage.

3. The power supply of claim 2, wherein said switching means is comprised of a MOSFET.

4. The power supply of claim 3, wherein said first sensing means receives a power supply voltage from said input node and said second sensing means receives said power supply voltage from said input node.

5. The power supply of claim 4, further comprising a voltage regulator, said voltage regulator having an input connected to said input node, and said regulator providing an output voltage to said switching means and said regulator providing an output voltage to said first sensing means.

* * * * *